US007641605B2

(12) United States Patent
McCarter

(10) Patent No.: US 7,641,605 B2
(45) Date of Patent: Jan. 5, 2010

(54) METHODS AND APPARATUS FOR BACK EXERCISE

(75) Inventor: Kyle Lee McCarter, Lebanon, IL (US)

(73) Assignee: Custom Product Innovations, Lebanon, IL (US)

( * ) Notice: Subject to any disclaimer, the term of this patent is extended or adjusted under 35 U.S.C. 154(b) by 120 days.

(21) Appl. No.: 11/470,153

(22) Filed: Sep. 5, 2006

(65) Prior Publication Data

US 2007/0087916 A1 Apr. 19, 2007

Related U.S. Application Data

(60) Provisional application No. 60/714,163, filed on Sep. 2, 2005.

(51) Int. Cl.
*A63B 26/00* (2006.01)

(52) U.S. Cl. ..... 482/142

(58) Field of Classification Search ..... 482/142, 482/96, 72, 112, 94, 92, 100, 102, 130, 135–136, 482/139

See application file for complete search history.

(56) References Cited

U.S. PATENT DOCUMENTS 5,037,090 A * 8/1991 Fitzpatrick ..... 482/112
5,070,863 A * 12/1991 McArthur et al. ..... 601/26
5,496,247 A * 3/1996 Anderson ..... 482/142
5,549,534 A * 8/1996 Parviainen ..... 482/137
D398,669 S * 9/1998 Anderson et al. ..... D21/662
6,086,157 A * 7/2000 Toso ..... 297/423.11
6,113,522 A * 9/2000 Fontenot et al. ..... 482/111
6,602,171 B1 * 8/2003 Tsen et al. ..... 482/140
6,776,743 B2 * 8/2004 Hur ..... 482/140
6,997,857 B2 * 2/2006 Bowman et al. ..... 482/148
7,086,992 B2 * 8/2006 Bowman et al. ..... 482/51
7,338,415 B2 * 3/2008 Giannelli ..... 482/97
7,360,840 B2 * 4/2008 Barlow et al. ..... 297/423.26
2004/0260222 A1 * 12/2004 Harris et al. ..... 602/32
2005/0096196 A1 * 5/2005 Webber et al. ..... 482/94
2005/0239602 A1 * 10/2005 Cordova et al. ..... 482/1
2008/0318741 A1 * 12/2008 Sencil et al. ..... 482/96

* cited by examiner

*Primary Examiner*—Lori Baker
(74) *Attorney, Agent, or Firm*—Armstrong Teasdale LLP

(57) ABSTRACT

Methods and apparatus for back exercise are provided. An exercise bench apparatus includes a beam positioned at an incline with respect to the horizontal, a seat member coupled to the beam wherein the seat member is configured to be positioned at a selectable position along the beam, a knee brace coupled to the beam, the knee brace configured to be positioned at a selectable position along the beam, and a stabilizer arm rotatable with respect to the beam and configured to be rotated away from a user in a first position, the stabilizer arm configured to engage the user in a second position such that a pelvic region of the user is substantially immobilized.

32 Claims, 7 Drawing Sheets

METHODS AND APPARATUS FOR BACK EXERCISE

CROSS REFERENCE TO RELATED APPLICATIONS

This application claims priority to U.S. Provisional Patent Application Ser. No. 60/714,163, filed Sep. 2, 2005, the contents of which are hereby incorporated by reference.

BACKGROUND OF THE INVENTION

This invention relates generally to an exercise apparatus and, more particularly, to an exercise apparatus that facilitates strengthening muscles in the human back.

To properly strengthen the lumbar extensor muscles it has been shown that isolation of these muscles during exercise is necessary to produce a functional increase in their strength.

Isolation of the spinal erector muscles is accomplished by isolating the lumbar spine, which may be done by anchoring the pelvis so that substantially no pelvic movement occurs. Once this is done, the objective is to rotate the torso upward in relation to the pelvis, which is restrained, causing a contraction of the spinal erector muscles. This isolation of lumbar function from pelvic function is important in producing a productive exercise for the spinal erector muscles.

Isolation of the spinal erector muscles may also be accomplished by tilting the patient's torso forward while the patient is in a kneeling or sitting position at an angle of approximately thirty degrees relative to the horizontal, with the forward movement of the patient's body being restrained by pads engaged against the knees. The patient's pelvis is isolated by a back restraint applied over the spine region at a predetermined height above the pelvis. The combination of the lumbar or back restraint and a contour kneeling pad provides isolation of the lumbar spinal movement and prevents pelvic rotation around the hip sockets, all of which causes the spinal erector muscles to become exercised when the patient bends forwardly and rearwardly about these restraints.

BRIEF DESCRIPTION OF THE INVENTION

In one embodiment, an exercise bench apparatus for strengthening the muscles of the lower back includes a beam positioned at an incline with respect to the horizontal, a seat member coupled to the beam, a knee brace coupled to the beam, and a stabilizer arm rotatable with respect to the beam and configured to be rotated away from a user in a first position, the stabilizer arm further configured to engage the user in a second position such that a pelvic region of the user is substantially immobilized.

In another embodiment, an exercise bench apparatus for strengthening the muscles of the lower back includes a beam positioned at an incline with respect to the horizontal and a stabilizer arm rotatable with respect to the beam and configured to be rotated away from a user in a first position, the stabilizer arm configured to engage the user in a second position such that a pelvic region of the user is substantially immobilized.

In yet another embodiment, a method of strengthening the muscles of the lower back using an exercise bench apparatus is provided. The exercise bench apparatus includes a seat member and a knee brace coupled to an incline beam and a stabilizer arm rotatable with respect to the beam wherein the stabilizer bar is configured to be rotated away from a user in a first position and to engage the user in a second position. The method includes positioning the knees of the user on the knee brace, positioning a posterior of the user against the seat member, rotating the stabilizer arm from the first position to the second position such that a back pad coupled to a distal end of the stabilizer arm engages the back of the user, and moving a torso of the user between an approximately upright seated position and a forwardly leaning position while maintaining the pelvic region of the user substantially immobilized using the back pad, seat member, and knee brace.

DETAILED DESCRIPTION OF THE INVENTION

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Figure 1:
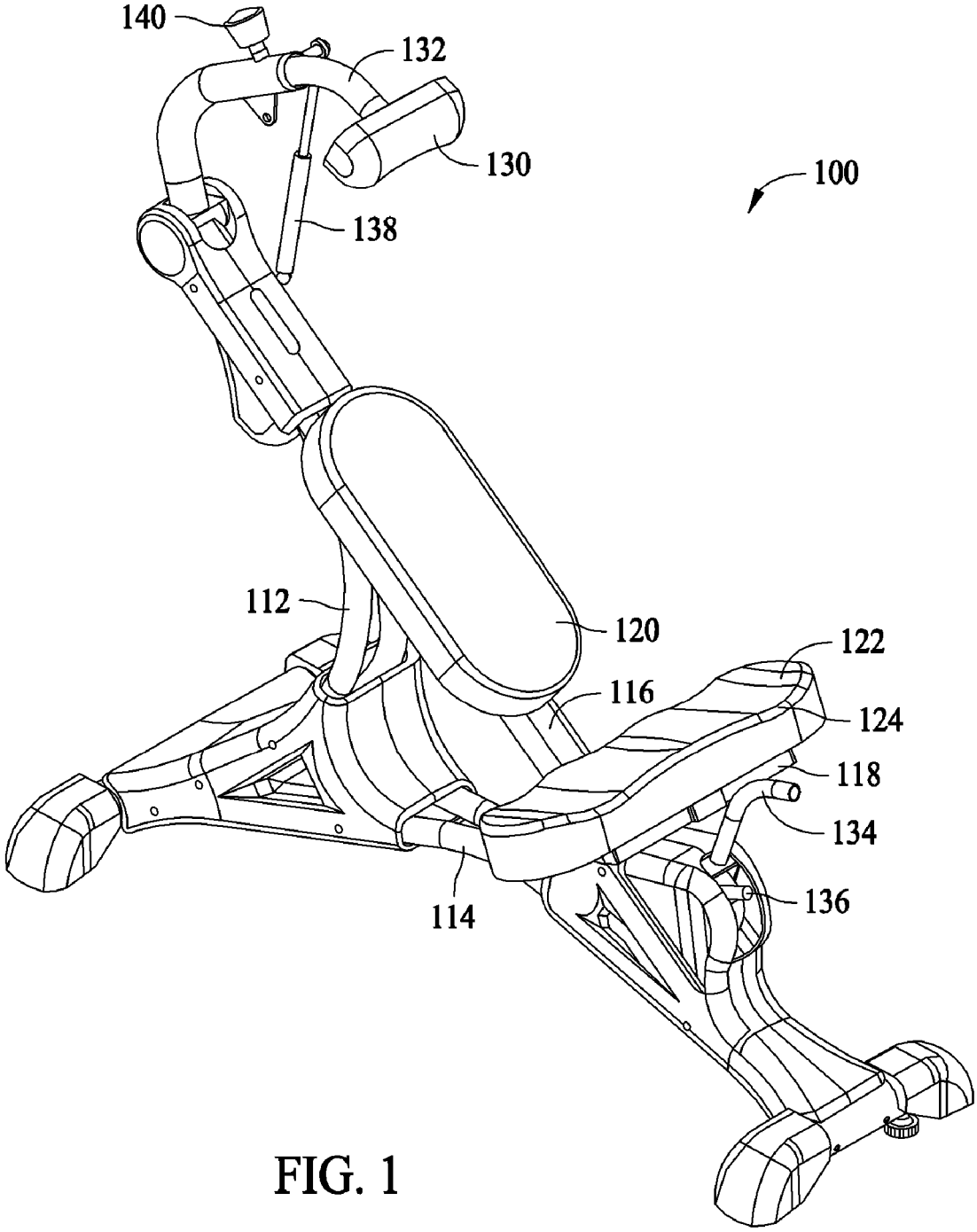
FIG. 1 is a perspective view of an exemplary back exercise apparatus.

FIG. 1 is a perspective view of an exemplary back exercise apparatus 100 suitable for accommodating a user in a seated position. Exercise apparatus 100 has one or more curvilinear support posts 112 mounted to a base 114 and supporting the rear end of an inclined beam 116. The front end of inclined beam 116 is supported by a forward end of base 114.

Inclined beam 116 is supported at an angle of approximately thirty degrees relative to the horizontal. The angle of inclination of beam 116 is chosen to increase the muscular activity required for moving the user's upper body from a forward-leaning position to an upright position. An angle of thirty degrees relative to the horizontal has been determined to optimally facilitate increasing the muscular activity required for moving the user's upper body from a forward-leaning position to an upright position, although an angle ranging from approximately twenty degrees to approximately forty degrees, relative to the horizontal, also provides an effective degree of muscular exercising.

A seat member 120 is coupled to an upper surface of inclined beam 116. A knee brace 122 is supported atop a support assembly 118 and is generally inclined at an angle proximately 120 degrees relative to the angle of incline of beam 116. Knee brace 122 may have a resilient surface 124 to support against the user's knees. Knee brace 122 is preferably inclined at an angle of approximately thirty degrees relative to the horizontal, thereby permitting a comfortable support to permit the user's lower legs to be positioned beneath seat member 120. Knee brace 122 is adjustable along inclined beam 116 for adjustment to accommodate a user's height and to accurately locate an adjustable back pad 130 during an exercise activity. Resilient surface 124 is contoured to complement the user's knees to facilitate locating and stabilizing the user's knees during the exercise activity.

Adjustable back pad 130 is coupled to the upper end of inclined beam 116 through a telescopic stabilizer arm 132. An opposite end of telescopic stabilizer arm 132 is rotatably coupled to inclined beam 116 such that back pad 130 may be rotated downward from a starting position toward a seated user where back pad 130 engages the user's back at a predetermined and adjustable location. A stabilizer lever 134 is coupled to telescopic stabilizer arm 132 via a cable (not shown in FIG. 1) fastened at a first end to stabilizer bar 134 and at a second end to telescopic stabilizer arm 132. A ratchet wheel and a spool (both not shown in FIG. 1) cooperate to maintain back pad 130 in a stable, fixed position when stabilizer lever 134 is released. An air pressure cylinder charges a chamber of gas to provide a returning bias when stabilizer lever 134 is depressed. A ratchet wheel pawl (not shown in FIG. 1) engages the ratchet wheel to lock the spool and ratchet wheel in position. Locking the spool and ratchet wheel results in back pad 130 being locked in a substantially fixed position against the user's back such that the user's pelvis is locked into a substantially non-rotatable position. A release lever 136 is configured to disengage the ratchet wheel pawl such that the bias force of air pressure cylinder 138 disengages back pad 130 from the user's back and returns it to the starting position. An adjustment knob 140 of telescopic stabilizer arm 132 facilitates positioning back pad 130 at a predetermined location of the user's back. Adjustments to the location of back pad 130 engaging the user's back facilitates isolating specific portions of the back and/or specific groups of muscles to improve the exercise results.

Back exercise apparatus 100 provides for strengthening the muscles of the lower back by confining a portion of the user's body in a relatively immobile position, while permitting the user to freely move between an approximately upright seated position and a forwardly leaning position. Back exercise apparatus 100 includes beam 116 fixedly mounted at a position which is inclined at substantially 30° relative to the horizontal, seat member 120 coupled to inclined beam 116, knee brace 122 coupled to inclined beam 116 and at a position spaced away from seat member 120 and proximate a lower end of inclined beam 116, restraint for immobilizing the upper portion of a user's legs relative to inclined beam 116 wherein the restraint includes a back pad 130 coupled to a telescoping pivot arm such that back pad 130 is selectively adjustable to the user's back.

Figure 2:
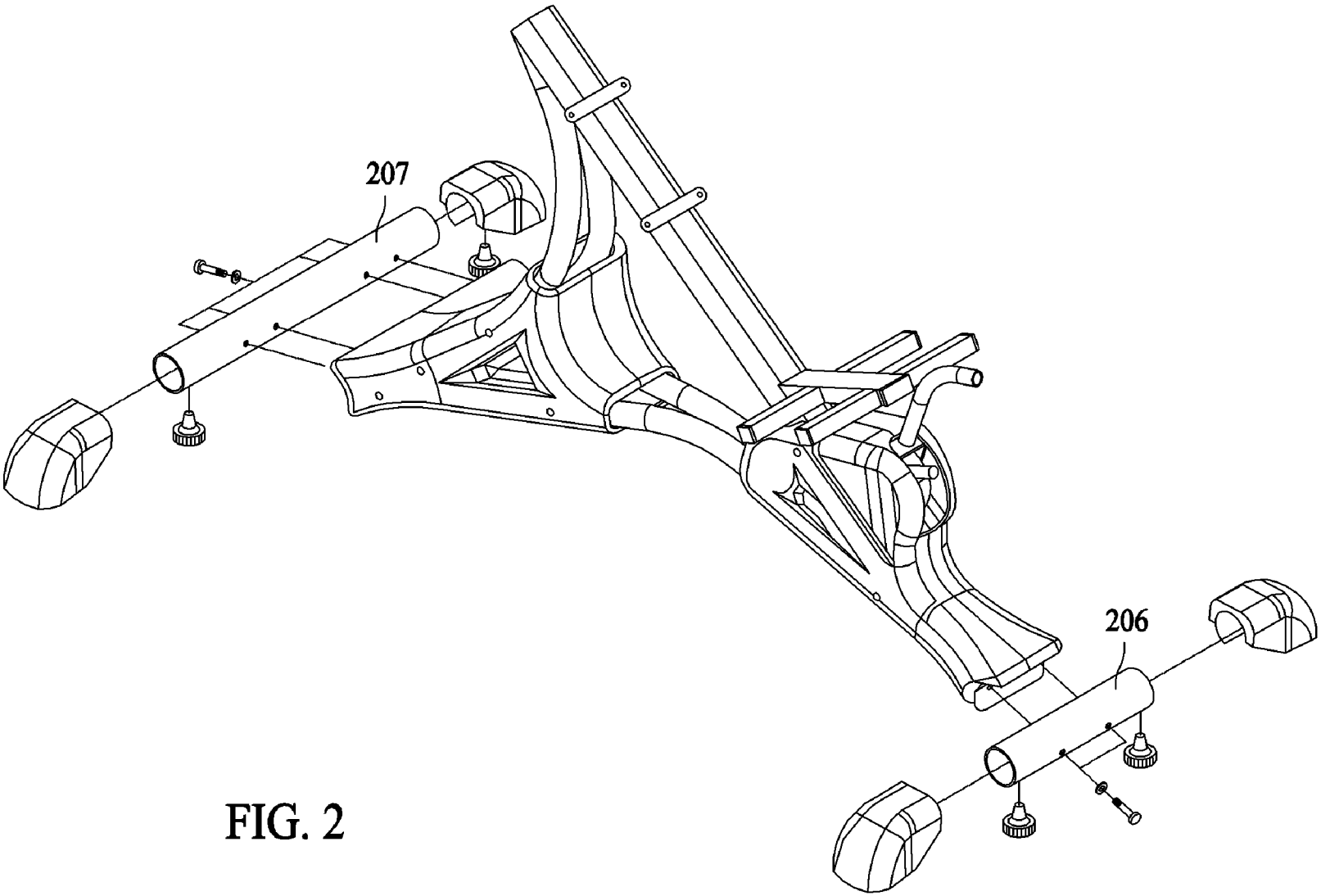
FIG. 2 is a partial exploded view with parts removed of the back exercise apparatus shown in FIG. 1.

FIG. 2 is a partial exploded view with parts removed of the back exercise apparatus shown in FIG. 1. A front base tube 206 is coupled to the front end of base 114 and a rear base tube 207 is coupled to a rear end of base 114 to provide lateral stability for device 100. In the exemplary embodiment, support assembly 118 includes a frame of channel members coupled at right angles with respect to each other and assembly 118 is coupled directly to inclined beam 116. In an alternative embodiment, support assembly 118 extends vertically from a front end of inclined beam 116 or alternatively, to a front end of base 114.

Figure 3:
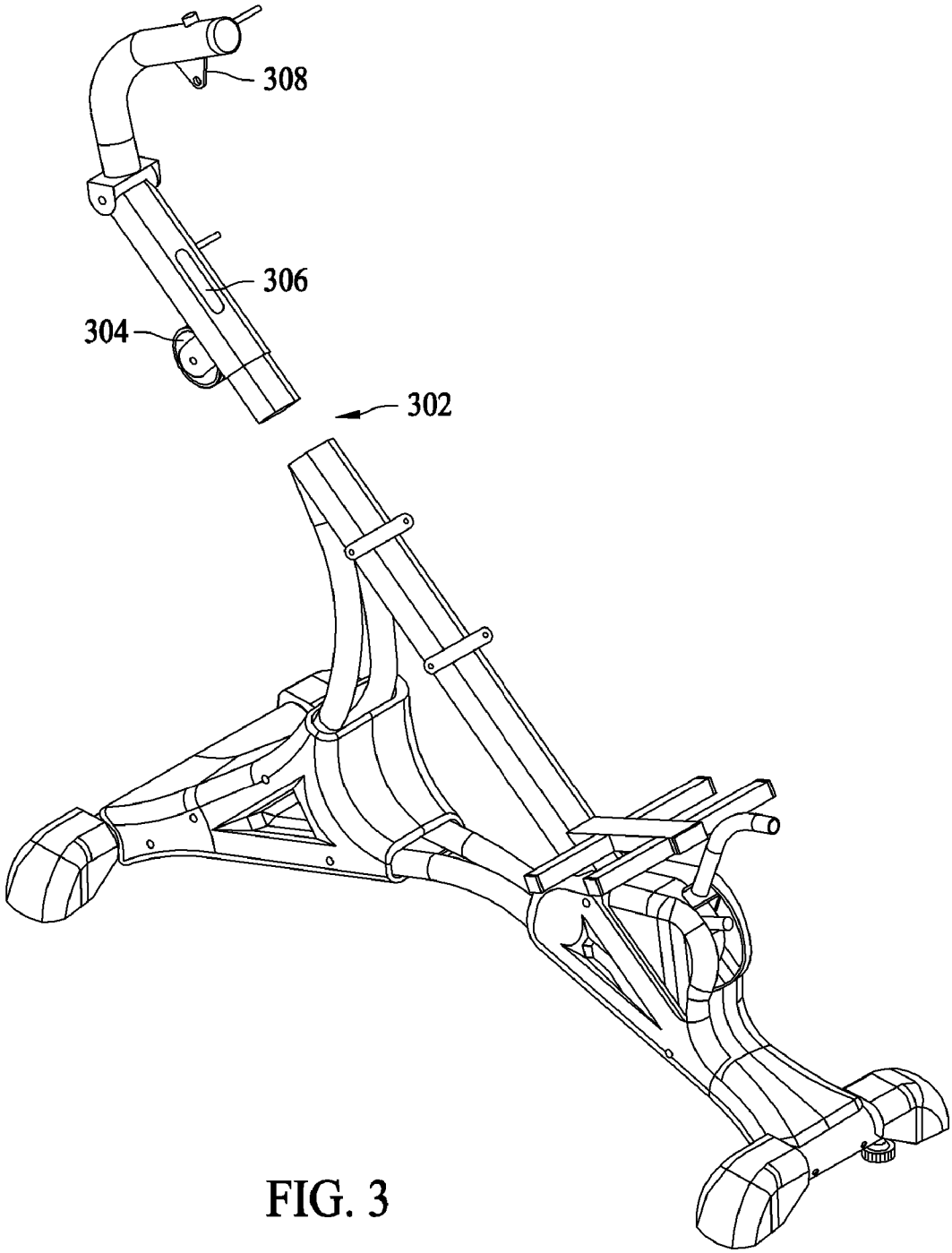
FIG. 3 is another partial exploded view with parts removed of the back exercise apparatus shown in FIG. 1.

FIG. 3 is another partial exploded view with parts removed of the back exercise apparatus shown in FIG. 1. Inclined beam 116 includes a socket joint 302 that facilitates breaking device 100 down into relatively small component parts to facilitate shipping, storage, and transportation. A wheel 304 channels the cable connecting stabilizer lever 134 to telescopic stabilizer arm 132 from a path along inclined beam 116 through an aperture 306 in inclined beam 116 to a connection pad 308 on telescopic stabilizer arm 132.

Figure 4:
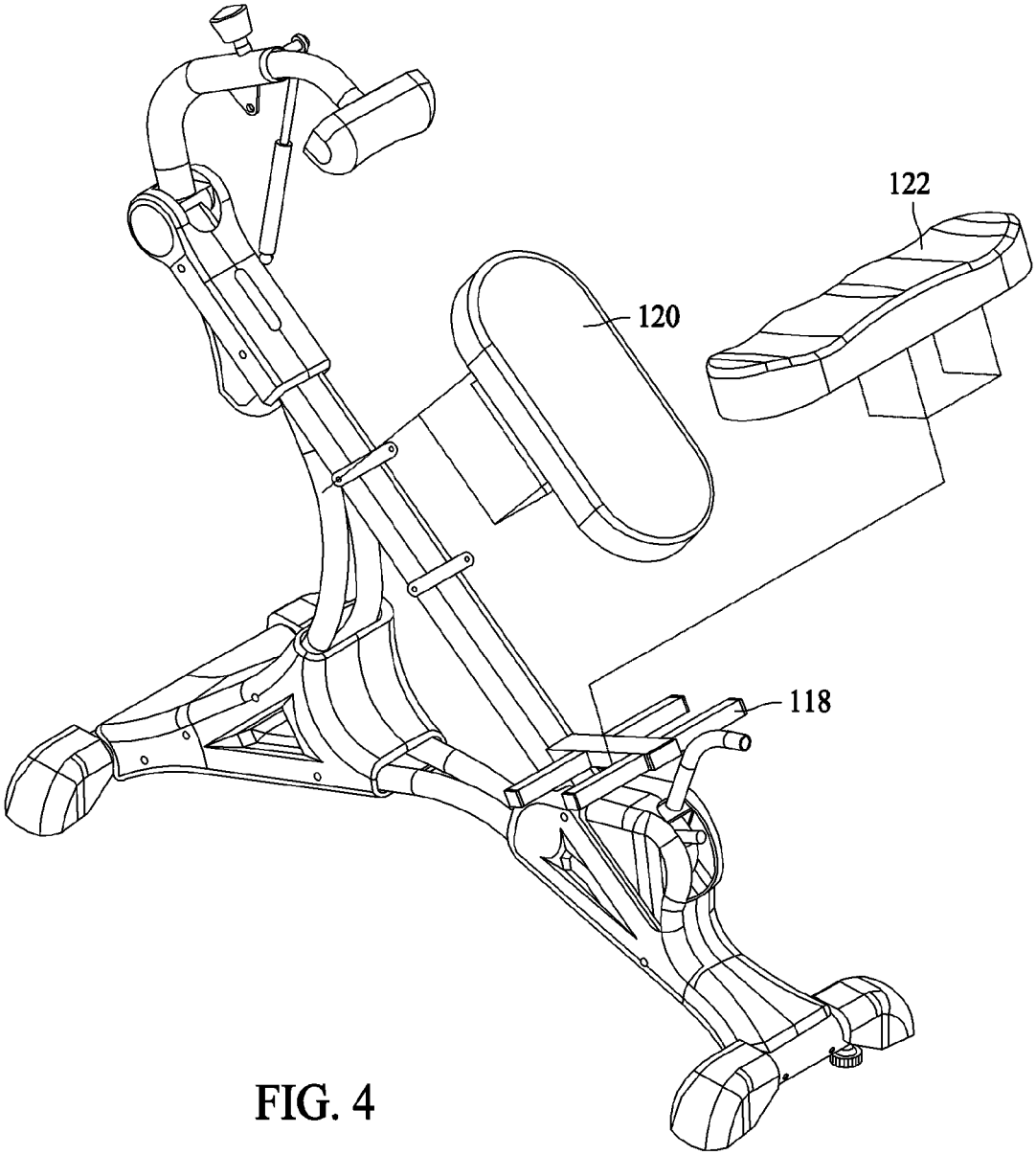
FIG. 4 is still another partial exploded view with parts removed of the back exercise apparatus shown in FIG. 1.
Figure 5:
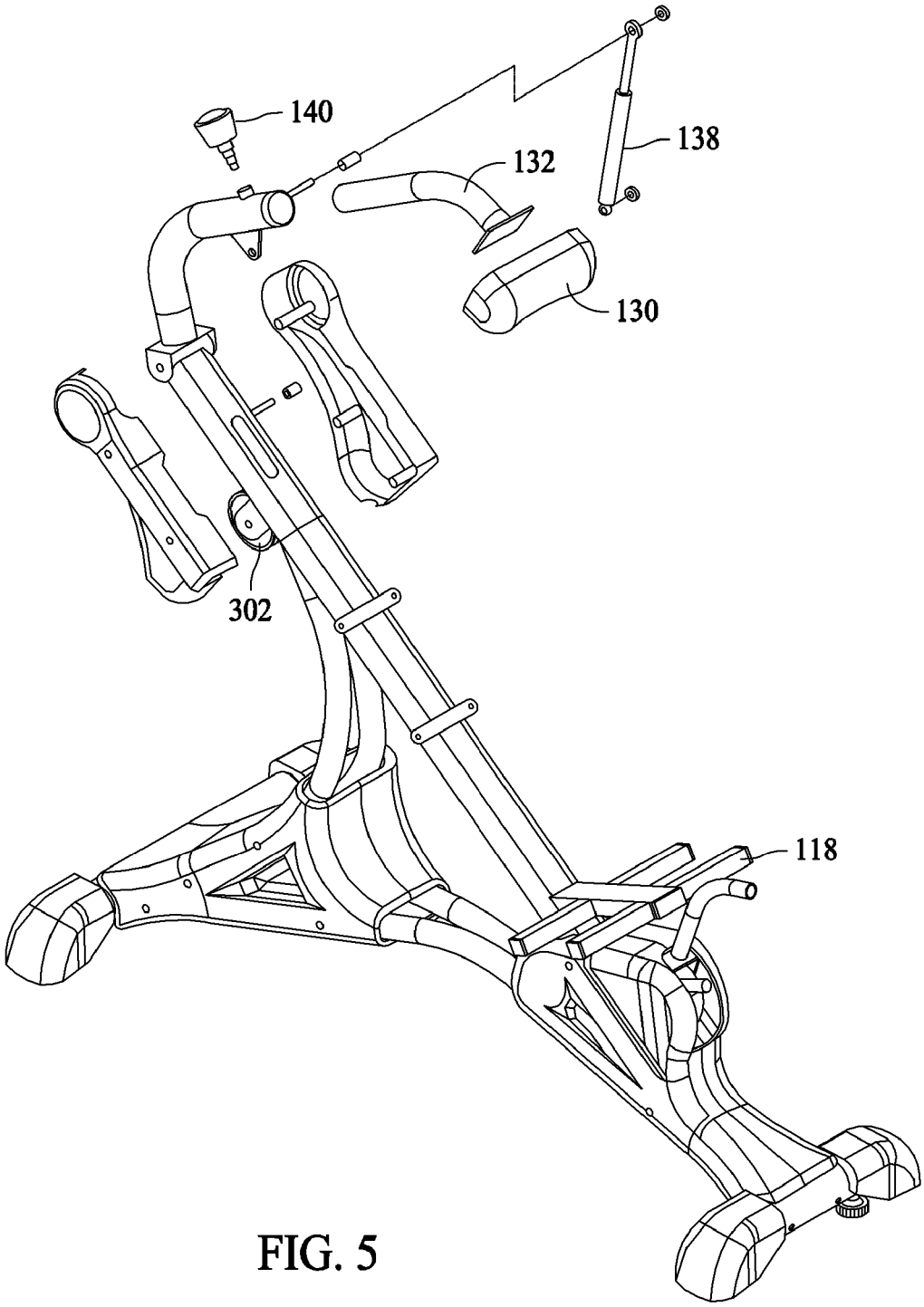
FIG. 5 is yet another partial exploded view with parts removed of the back exercise apparatus shown in FIG. 1.
Figure 6:
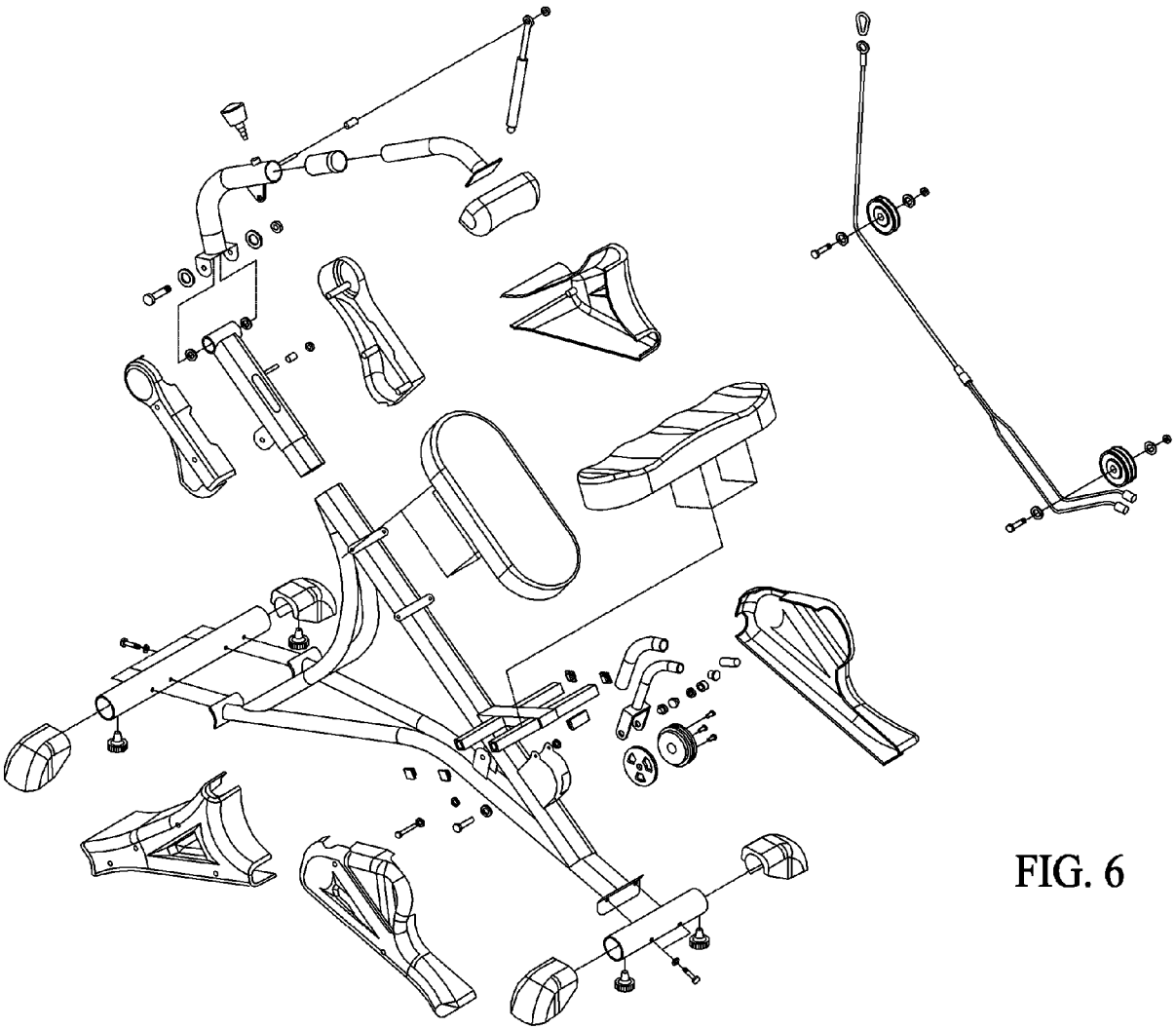
FIG. 6 is an exploded view of the back exercise apparatus shown in FIG. 1.

FIG. 4 is still another partial exploded view with parts removed of the back exercise apparatus shown in FIG. 1. FIG. 5 is yet another partial exploded view with parts removed of the back exercise apparatus shown in FIG. 1; and FIG. 6 is an exploded view of the back exercise apparatus shown in FIG. 1.

Figure 7:
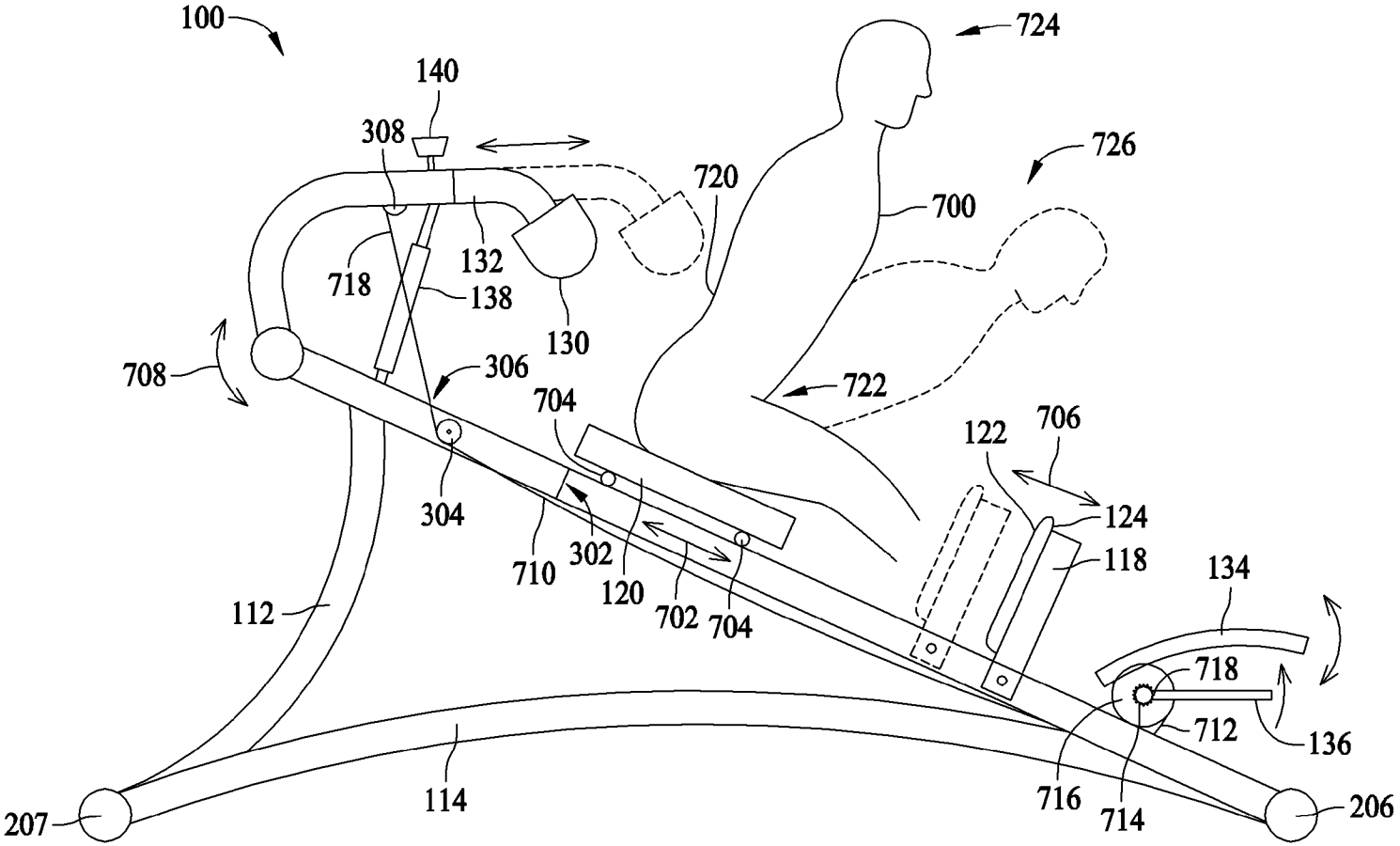
FIG. 7 is a side schematic view of an exemplary embodiment of the back exercise apparatus shown in FIG. 1.

FIG. 7 is a side schematic view of an exemplary embodiment of back exercise apparatus 100 (shown in FIG. 1).

Exercise apparatus 100 has one or more curvilinear support posts 112 mounted to a base 114 and supporting the rear end of an inclined beam 116. The front end of inclined beam 116 is supported by a forward end of base 114. A front base tube 206 is coupled to the front end of base 114 and a rear base tube 207 is coupled to a rear end of base 114 to provide lateral stability for device 100. In the exemplary embodiment, support assembly 118 includes a frame of channel members coupled at right angles with respect to each other and assembly 118 is coupled directly to inclined beam 116. In an alternative embodiment, support assembly 118 extends vertically from a front end of inclined beam 116 or alternatively, to a front end of base 114.

Inclined beam 116 is supported at an angle of approximately thirty degrees relative to the horizontal. The angle of inclination of beam 116 is chosen to increase the muscular activity required for moving a user's 700 upper body from a forward-leaning position to an upright position. An angle of approximately thirty degrees relative to the horizontal has been determined to optimally facilitate increasing the muscular activity required for moving the user's upper body from a forward-leaning position to an upright position, although an angle ranging from approximately twenty degrees to approximately forty degrees, relative to the horizontal, also provides an effective degree of muscular exercising. Inclined beam 116 includes a socket joint 302 that facilitates breaking device 100 down into relatively small component parts to facilitate shipping, storage, and transportation. A wheel 304 channels the cable connecting stabilizer lever 134 to telescopic stabilizer arm 132 from a path along inclined beam 116 through an aperture 306 in inclined beam 116 to a connection pad 308 on telescopic stabilizer arm 132.

A seat member 120 is coupled to an upper surface of inclined beam 116. In the exemplary embodiment, seat member 120 is adjustable along inclined beam 116 in a direction 702 using an adjustment system 704 that includes one or more pins insertable through holes positioned in inclined beam to permit fixing seat member 120 in a selectable position. In alternative embodiments adjustment system 704 may comprise a rack and pinion, a rack and pawl, a releasable friction fit, or any other adjustment capable of providing the function described herein. A knee brace 122 is supported atop a support assembly 118 and is generally inclined at an angle proximately 120 degrees relative to the angle of incline of beam 116. Knee brace 122 includes a resilient surface 124 to support against the user's knees. Knee brace 122 is preferably inclined at an angle of approximately thirty degrees relative to the horizontal, thereby permitting a comfortable support to permit the user's lower legs to be positioned beneath seat member 120. Knee brace 122 is adjustable along inclined beam 116 in a direction 706 for adjustment to accommodate, for example, a user's height and to accurately locate an adjustable back pad 130 during an exercise activity. Resilient surface 124 is contoured to complement the user's knees to facilitate locating and stabilizing the user's knees during the exercise activity.

Adjustable back pad 130 is coupled to the upper end of inclined beam 116 through a telescopic stabilizer arm 132. An opposite end of telescopic stabilizer arm 132 is rotatably coupled to inclined beam 116 such that back pad 130 may be rotated in a downward direction 708 from a starting position toward a seated user where back pad 130 engages the user's back at a predetermined and adjustable location. A stabilizer lever 134 is coupled to telescopic stabilizer arm 132 via a cable 710 fastened at a first end 712 to stabilizer bar 134 through a ratchet wheel 714 and a spool 716 and at a second end 718 to telescopic stabilizer arm 132. Ratchet wheel 714 and spool 716 cooperate to maintain back pad 130 in a stable, fixed position when stabilizer lever 134 is manipulated to take-up cable 710 onto spool 716. An air pressure cylinder charges a chamber of gas to provide a returning bias when stabilizer lever 134 is manipulated to take-up cable 710. A ratchet wheel pawl 718 engages ratchet wheel 714 to lock spool 716 and ratchet wheel 714 in a position wherein back pad 130 engages a back area 720 of user 700. Locking spool 716 and ratchet wheel 714 results in back pad 130 being locked in a substantially fixed position against the user's back 720 such that the user's pelvis 722 is locked into a substantially non-rotatable position. Release lever 136 is configured to disengage ratchet wheel pawl 718 such that the bias force of air pressure cylinder 138 disengages back pad 130 from the user's back and returns it to the starting position. An adjustment knob 140 of telescopic stabilizer arm 132 facilitates positioning back pad 130 at a predetermined location of the user's back. Adjustments to the location of back pad 130 engaging the user's back facilitates isolating specific portions of the back and/or specific groups of muscles to improve the exercise results.

Back exercise apparatus 100 provides for strengthening the muscles of the lower back by confining a portion of the user's body in a relatively immobile position, while permitting the user to freely move between an approximately upright seated position 724 and a forwardly leaning position 726. In the exemplary embodiment, back exercise apparatus 100 includes beam 116 fixedly mounted at a position which is inclined at substantially thirty degrees relative to the horizontal, seat member 120 coupled to inclined beam 116. In an alternative embodiment, beam 116 is selectably configured to be adjustable to a plurality of angles of incline with respect to the horizontal. Such adjustably provides a user with a variety of positions from which to isolate and exercise various portions of user's back 720.

The above-described embodiments of a back exercise device provide a cost-effective and reliable means for isolating various muscle groups in the back, so that they may be more effectively exercised using the natural weight of the upper torso of the user's body. The seat, knee brace, and back pad are configured to provide ergonomic and comfort features and effectively stabilize the pelvis in a substantially non-movable position during the exercise. Immobilizing the pelvis facilitates isolating the muscle groups of the user's back to limit the contribution of the user's legs in performing the exercise.

Exemplary embodiments of the back exercise apparatus are described above in detail. The back exercise apparatus components illustrated are not limited to the specific embodiments described herein, but rather, components of each apparatus may be utilized independently and separately from other components described herein. For example, the back exercise apparatus components described above may also be used in combination with different back exercise apparatus components.

While the invention has been described in terms of various specific embodiments, those skilled in the art will recognize that the invention can be practiced with modification within the spirit and scope of the claims.

What is claimed is:

1. An exercise bench apparatus for use in strengthening muscles of a lower back of a user, said apparatus comprising:

a beam positioned at an incline with respect to the horizontal, said beam comprising a first end, a second end, and a body extending linearly between said first end and said second end;

a seat member coupled to said first end;

a knee brace coupled to said second end, said knee brace configured to maintain contact with a knee of the user during an exercise activity; and a stabilizer arm rotatable by the user between a first position used by the user to mount the exercise bench apparatus and to dismount the exercise bench apparatus and a second fixed position used during the exercise activity, in the first position said stabilizer arm is rotated away from the lower back of the user, in the second fixed position, said stabilizer arm maintains contact with the lower back of the user during the exercise activity such that a pelvic region of the user is immobilized by a force provided by the stabilizer arm through the user to the knee brace;

wherein said seat member, said knee brace, and said stabilizer arm are stationary with respect to each other during the exercise activity.

2. An apparatus in accordance with claim 1 wherein said beam is fixedly positioned at an incline of from approximately twenty degrees to approximately forty degrees with respect to the horizontal.

3. An apparatus in accordance with claim 1 wherein said beam is fixedly positioned at an incline of approximately thirty degrees with respect to the horizontal.

4. An apparatus in accordance with claim 1 wherein said stabilizer arm further comprises a telescoping section adjustable between an extended first position and a retracted second position.

5. An apparatus in accordance with claim 1 wherein said stabilizer arm comprises an adjustable back pad configured to engage a back of the user, said stabilizer arm further comprises a telescoping section adjustable between an extended first position and a retracted second position wherein with said telescoping section in the first position the back pad engages the user at a first location, with said telescoping section in the second position the back pad engages the user at a second location, said second location being lower on the back than the first location.

6. An apparatus in accordance with claim 1 wherein said stabilizer arm is biased in the first position.

7. An apparatus in accordance with claim 1 wherein said stabilizer arm is biased in the first position using a gas charged cylinder.

8. An apparatus in accordance with claim 1 wherein said stabilizer arm is rotatable from the first position to the second position using a cable coupled between the stabilizer arm and a ratcheting mechanism.

9. An apparatus in accordance with claim 8 wherein said ratcheting mechanism is positioned between said knee brace and a lower end of said beam.

10. An apparatus in accordance with claim 8 wherein said ratcheting mechanism comprises a release member configured to permit said stabilizer arm to return to the first position using a bias member.

11. An apparatus in accordance with claim 1 wherein said seat member is configured to be positioned at a selectable position along said beam.

12. An apparatus in accordance with claim 1 wherein said knee brace is configured to be positioned at a selectable position along said beam.

13. An apparatus in accordance with claim 1 wherein said knee brace comprises a contour complementary to the user's knees.

14. An exercise bench apparatus for use in strengthening muscles of a lower back of a user, said apparatus comprising:

a beam positioned at an incline with respect to the horizontal, said beam comprising a first end, a second end, and a body extending linearly between said first end and said second end; and a stabilizer arm rotatable between a first position used by the user to mount the exercise bench apparatus and to dismount the exercise bench apparatus and a second fixed position used during an exercise activity, in the first position, the stabilizer arm is rotated away from the user such that said stabilizer arm does not touch the user, in the second position, said stabilizer arm engages the back of the user in the fixed second position during the exercise activity such that a pelvic region of the user is immobilized by a force provided by the stabilizer arm, wherein said stabilizer arm is stationary with respect to the beam during the exercise activity.

15. An apparatus in accordance with claim 14 further comprising a seat member coupled to said beam, said seat member configured to be positioned at a selectable position along said beam.

16. An apparatus in accordance with claim 14 further comprising a knee brace coupled to said beam, said knee brace configured to be positioned at a selectable position along said beam.

17. An apparatus in accordance with claim 14 wherein said knee brace is inclined at an angle of approximately thirty degrees with respect to the horizontal.

18. An apparatus in accordance with claim 14 wherein said knee brace comprises a contour complementary to the user's knees.

19. An apparatus in accordance with claim 14 wherein said beam is fixedly positioned at an incline of from approximately twenty degrees to approximately forty degrees with respect to the horizontal.

20. An apparatus in accordance with claim 14 wherein said beam is fixedly positioned at an incline of approximately thirty degrees with respect to the horizontal.

21. An apparatus in accordance with claim 14 wherein said stabilizer arm further comprises a telescoping section adjustable between an extended first position and a retracted second position.

22. An apparatus in accordance with claim 14 wherein said stabilizer arm comprises an adjustable back pad configured to engage a back of the user, said stabilizer arm further comprises a telescoping section adjustable between an extended first position and a retracted second position wherein with said telescoping section in the first position the back pad engages the user at a first location, with said telescoping section in the second position the back pad engages the user at a second location, said second location being lower on the back than the first location.

23. An apparatus in accordance with claim 14 wherein said stabilizer arm is biased in the first position using a gas charged cylinder.

24. An apparatus in accordance with claim 14 further comprising a cable coupled between the stabilizer arm and a ratcheting mechanism.

25. An apparatus in accordance with claim 24 wherein said ratcheting mechanism is positioned between said knee brace and a lower end of said beam.

26. An apparatus in accordance with claim 24 wherein said ratcheting mechanism comprises a release member configured to permit said stabilizer arm to return to the first position using a bias member.

27. A method of strengthening muscles of a lower back of a user using an exercise bench apparatus comprising a seat member coupled to a first end of an incline beam, a knee brace coupled to a second end of the incline beam, and a stabilizer arm rotatable between a first position used by the user to mount the exercise bench apparatus and to dismount the exercise bench apparatus and a second fixed position used during the exercise activity, the stabilizer arm is rotated away from the user in the first position and engages the user in the second position, said method comprising:

positioning the knees of the user on the knee brace;

positioning a posterior of the user against the seat member;

rotating the stabilizer arm from the first position, where the stabilizer arm does not touch the user to the second position wherein the stabilizer arm engages the lower back of the user and wherein the stabilizer arm remains in the second fixed position during the exercise activity; and moving a torso of the user between an approximately upright seated position and a forwardly leaning position while maintaining the pelvic region of the user immobilized using the stabilizer arm, seat member, and knee brace, wherein the seat member, the knee brace, and the stabilizer arm are stationary with respect to each other during the exercise activity.

28. A method in accordance with claim 27 further comprising adjusting an angle of incline of the incline beam with respect to the horizontal.

29. A method in accordance with claim 27 further comprising adjusting a position of the seat member along the inclined beam.

30. A method in accordance with claim 27 further comprising adjusting a position of the knee brace along the inclined beam.

31. A method in accordance with claim 27 wherein the stabilizer arm includes a telescopic section adjustable between a retracted position and an extended position, said method further comprising adjusting the length of the stabilizer arm between the retracted position and the extended position.

32. A method in accordance with claim 27 wherein rotating the stabilizer arm comprises positioning the user between the back pad, seat member, and knee brace such that the upper legs and pelvic region of the user are wedged between the back pad, seat member, and knee brace maintaining the pelvic region of the user immobilized using the back pad, the seat member, and the knee brace.

* * * * *